US008789977B2

(12) United States Patent
Villard

(10) Patent No.: US 8,789,977 B2
(45) Date of Patent: Jul. 29, 2014

(54) METHODS AND APPARATUS FOR LED LIGHTING WITH HEAT SPREADING IN ILLUMINATION GAPS

(71) Applicant: Cree, Inc., Durham, NC (US)

(72) Inventor: Russell G. Villard, Apex, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/691,934

(22) Filed: Dec. 3, 2012

(65) Prior Publication Data

US 2013/0094213 A1 Apr. 18, 2013

Related U.S. Application Data

(63) Continuation of application No. 13/163,994, filed on Jun. 20, 2011, now abandoned, which is a continuation of application No. 12/143,899, filed on Jun. 23, 2008, now Pat. No. 7,976,202.

(51) Int. Cl.

| | |
|---|---|
| ***F21V 29/00*** | (2006.01) |
| ***F21S 4/00*** | (2006.01) |
| ***F21V 21/02*** | (2006.01) |
| *F21Y 103/00* | (2006.01) |

(52) U.S. Cl.

CPC ..... *F21V 29/004* (2013.01); *F21S 4/008* (2013.01); *F21V 21/02* (2013.01); *F21Y 2103/003* (2013.01)

USPC ..... 362/294; 362/249.02; 362/249.06; 362/373; 362/404

(58) Field of Classification Search

USPC ..... 362/294, 373, 218, 219, 249.01, 362/249.02, 249.06, 249.14, 404–407

See application file for complete search history.

(56) References Cited

U.S. PATENT DOCUMENTS

| | | | | |
|---|---|---|---|---|
| 5,783,909 | A | 7/1998 | Hochstein | |
| 6,573,536 | B1 | 6/2003 | Dry | |
| 7,434,964 | B1 | 10/2008 | Zheng | |
| 2005/0281030 | A1 * | 12/2005 | Leong et al. | 362/234 |
| 2010/0314985 | A1 | 12/2010 | Premysler | |

OTHER PUBLICATIONS

William R. Hamburgen, Optimal Finned Heat Sinks, pp. i-vii, Nov. 1-3, 1986, Digital Western Research Laboratory, Palo Alto, Ca.

* cited by examiner

*Primary Examiner* — Thomas Sember

(74) *Attorney, Agent, or Firm* — Law Office of Peter H. Priest, PLLC

(57) ABSTRACT

Techniques for light emitting diode (LED) lighting with heat spreading in illumination gaps. Inexpensive structural aluminum may be suitably employed to form a passive heat spreading mount for plural LEDs whose illumination collectively combines to provide the light needed by a particular lighting fixture, such as a pendant chandelier, by way of example, by angling fins of the passive heat spreading mount to correspond to illumination gaps of the LEDs.

20 Claims, 7 Drawing Sheets

METHODS AND APPARATUS FOR LED LIGHTING WITH HEAT SPREADING IN ILLUMINATION GAPS

This application is a continuation of U.S. patent application Ser. No. 13/163,994 entitled "Methods and Apparatus for LED Lighting with Heat Spreading in Illumination Gaps" filed on Jun. 20, 2011 which is a continuation of U.S. patent application Ser. No. 12/143,899 entitled "Methods and Apparatus for LED Lighting with Heat Spreading in Illumination Gaps" filed on Jun. 23, 2008 both of which are hereby incorporated by reference in their entirety.

FIELD OF THE INVENTION

The present invention relates generally to improvements in light emitting diode (LED) lighting methods and apparatus, and more particularly to advantageous arrangements for locating heat spreading components in illumination gaps of LEDs mounted in lighting fixtures.

BACKGROUND OF THE INVENTION

LED lighting systems are becoming more prevalent as replacements for existing lighting systems. LEDs are an example of solid state lighting and are superior to traditional lighting solutions such as incandescent and fluorescent lighting because they use far less energy, are far more durable, operate longer, can be combined in red-blue-green arrays that can be controlled to deliver virtually any color light, and contain no lead or mercury. As LEDs replace the typical incandescent and fluorescent light fixtures found in many homes and workplaces, the present invention recognizes that it is important to cost effectively dissipate the heat generated by the LEDs used in these systems while maintaining the aesthetically pleasing look of existing lighting hardware.

As illustrated by FIGS. 1A, 1B and 1C, a common prior art LED mounting arrangement results in a substantial portion of the light output going outwardly in the direction of a normal to the top surface of a semiconductor photonic chip 12 as seen in FIG. 1B. As seen in FIG. 1A, a top view of an LED 10, the semiconductor photonic chip 12 is mounted on a substrate 14 which is in turn mounted on a bonding pad 16. The chip 12 is encapsulated beneath an optical lens 18 which focuses the light emitted by the chip 12.

FIG. 1B shows a side view of LED 10 with a plurality of light rays relative to a normal, N, to the top surface of chip 12 illustrating the light emitted by chip 12 as it passes out of lens 18. LED 10 is an XLamp™ from Cree, Incorporated.

FIG. 1C shows an illustrative plot of the light emitted by LED 10 with the y-axis representing the intensity, I, and the x-axis representing the angle, $\theta$, of the emitted light with respect to the normal, N, of FIG. 1B. As illustrated in FIG. 1C, a substantial portion of the light emitted from the LED is along or near the normal, N. Conversely, only a small percentage is emitted transverse to the normal. Angle $\alpha$, the angle of intensity, is equal to $2*\theta$.

One common lighting fixture is a ceiling mounted lighting fixture such as a pendant chandelier 200 shown illustratively in FIG. 2A. Fixture 200 may suitably comprise a cord 202 including electrical wires connecting to electrical circuitry located in a ceiling 240, a mounting socket 204, a light bulb 206 which may suitably be an incandescent or fluorescent bulb, and a decorative glass shade 208. Many other variations on ceiling mounted lighting fixtures are common, such as multiple light units with a wide variety of mounts. Similarly, a wide variety of floor and wall mounted lighting fixtures are available. With incandescent bulb and fluorescent bulb versions of pendant chandelier 200, heat from bulb 206 is dissipated into the ambient air around the bulb 206.

FIG. 2B shows one prior art attempt at an LED based chandelier fixture 250. In FIG. 2B, circle 252 represents the diameter of the glass of chandelier fixture 250. In the fixture 250, a first plurality of LEDs 253, 254, 255 and 256 were mounted on a mount 260 having three fins at each corner of the mount 260. A second plurality of LEDs (not shown) was spaced vertically on the mount 260 from the first plurality. All of the LEDs were Nichia LEDs.

SUMMARY OF THE INVENTION

Among its several aspects, the present invention recognizes that in replacing an incandescent or fluorescent bulb or bulbs with multiple LEDs capable of providing a comparable amount of room light in a lighting fixture such as a pendant chandelier, it is necessary to redesign the fixture to provide adequate heat dissipation while maintaining the overall aesthetic appeal of the fixture. With such multiple LED fixtures, the present invention recognizes that a balance must be struck to avoid hot spots while satisfactorily dissipating the heat generated by multiple LEDs. To such ends, the present invention addresses advantageous methods and apparatus for LED lighting with heat spreading in illumination gaps.

In one aspect of the invention, a heat spreading light emitting diode (LED) mounting arrangement comprises a heat spreading base unit having plural flat mounting areas with each of said plural flat mounting areas having one or more associated angled fins; and at least two LEDs mounted on at least two of the plural flat mounting areas, said at least two LEDs having an angle of intensity so that in operation a substantial majority of emitted light from said at least two LEDs is within a viewing angle in which the intensity of emitted light is 50% of the maximum intensity or higher. Said one or more associated angled fins have an angle so that said fins are located in illumination gaps of said at least two LEDs, a gap for purposes of this application being outside the viewing angle, or in other words, in a location in which the intensity of emitted light is less than or equal to 50% of the maximum intensity of emitted light. In this heat spreading LED mounting arrangement, the heat spreading base unit may suitably be formed of structural aluminum. The heat spreading LED mounting arrangement may further comprise an end cap unit supporting a further LED mounting arrangement thereon. In the heat spreading LED mounting arrangement, said at least two LEDs may be spaced along a length of said base unit.

In a further aspect, the heat spreading LED mounting arrangement comprises four LEDs which are mounted about a central axis of the base unit and eight angled fins are angled at an angle $\gamma$ of approximately 45° with respect to normals, N, to four flat mount areas on which the four LEDs are mounted. In this heat spreading LED mounting arrangement wherein four LEDs are employed, these LEDs collectively operate to provide 360° illumination.

These and other advantages and aspects of the present invention will be apparent from the drawings and Detailed Description which follow.

DETAILED DESCRIPTION

Figure 3:
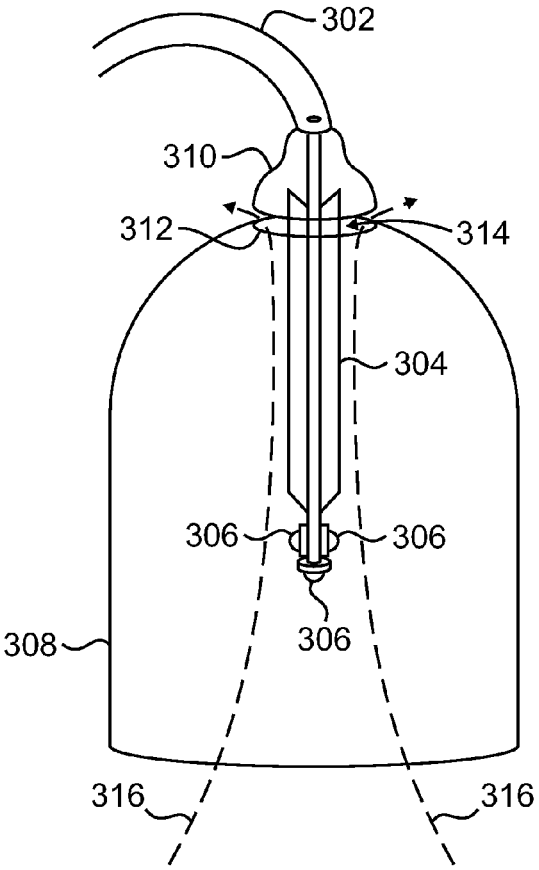
FIG. 3 illustrates an exemplary embodiment of an LED chandelier lighting fixture in accordance with the present invention.

FIG. 3 illustrates a first embodiment of an LED lighting fixture, a pendant chandelier 300, in accordance with the invention. Chandelier 300 includes a power cord 302, an aluminum heat spreading LED mount 304, a plurality of LEDs 306 and a glass or plastic shade 308. A mounting cap 310 fits over electrical cord 302 and covers most of an opening 312 which allows insertion of the heat spreading LED mount 304 and LEDs 306 into the interior of the shade 308 upon assembly of the chandelier 300.

The mounting cap 310 covers the opening 312 with the exception of an air gap or air gaps 314 to allow airflow as follows. When hung from a ceiling and in normal operation, heat from the LEDs 306 is transferred to the heat spreading LED mount 304 and to the surrounding air inside the glass shade 308. The heated air rises escaping from the air gap 314. Cooler air is drawn into the bottom of the glass shade so that a flow of heat dissipating air as represented by dashed lines 316 cools the fins of the mount 304 and the LEDs 306. In FIG. 3, heat sink fins for the LEDs and an LED facing the viewer are not shown to better illustrate the overall chandelier 300. Further details of the fins and the mounting of LEDs 306 are shown in FIGS. 4A-4E and described below.

FIGS. 4A, 4B, 4C, 4D, 4E and 4F illustrate details of embodiments of a mount 450 suitable for use as the mount 304 in FIG. 3. Effective heat dissipation and a cost effective price are two design criteria for selecting the materials for the mount 450. While pure aluminum has a conductivity of approximately 200° C./watt, a more affordable and readily available structural aluminum T bar has a conductivity of approximately 160° C./watt and provides a cost effective choice for the mount 450.

Figure 4A:
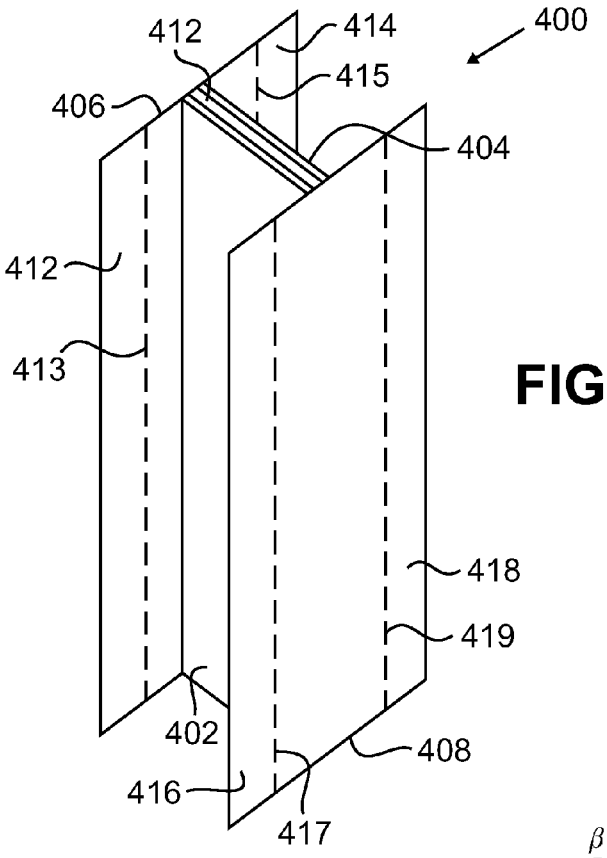
FIGS. 4A, 4B, 4C, 4D, 4E and 4F illustrate further aspects of LED mounting arrangements in accordance with the present invention.
Figure 4B:
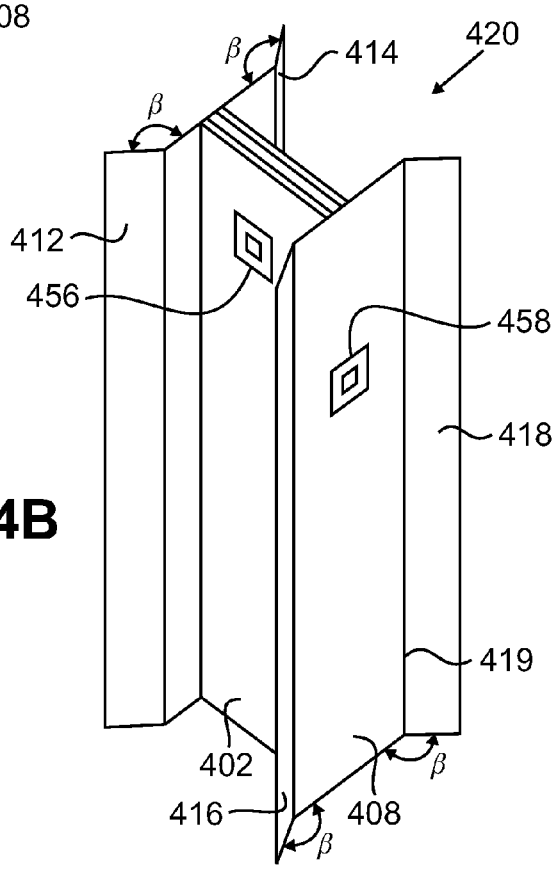
Figure 4C:
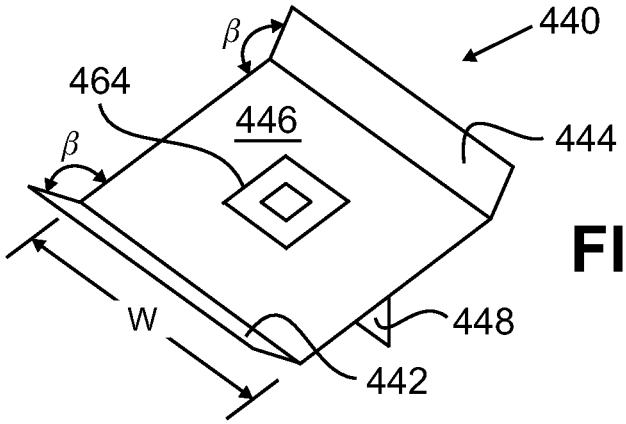
Figure 4D:
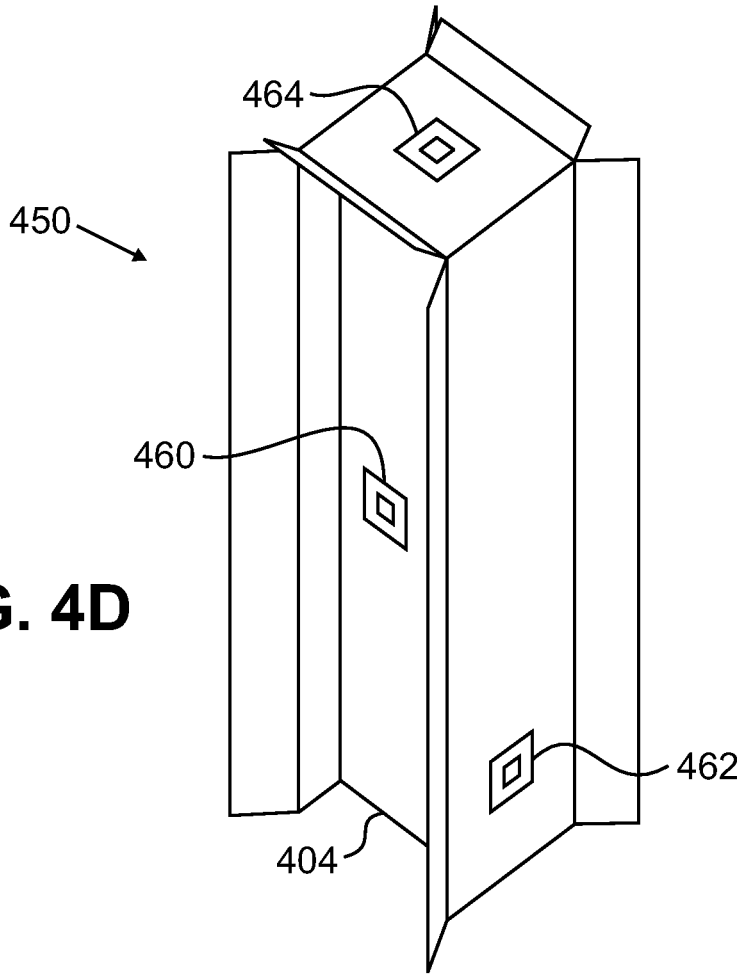

After cutting about 0.5" from bases 402 and 404 of three inch pieces 406 and 408 of T-shaped aluminum 6061, the two pieces 406 and 408 can be joined together as shown in FIG. 4A with a layer of thermal gap filler 419, such as a thermal epoxy, sandwiched between the two bases 402 and 404 to form a preform 400 utilized to make the mount 450 shown in FIG. 4D.

As seen in FIG. 4B a base unit 420 is formed by bending ends 412 and 414 of piece 406 at fold lines 413 and 415, respectively, and ends 416 and 418 of piece 408 at fold lines 417 and 419, respectively, at an angle β of approximately 45°.

As further seen in FIG. 4B, LEDs 456 and 458 are mounted on base 402 and on the face of piece 408. FIG. 4D shows the mount 450 rotated 180° so that base 404 and piece 406 are exposed to the viewer and it is seen that further LEDs 460 and 462 are mounted on base 404 and piece 406, respectively. As seen from FIGS. 4B and 4D, the LEDs 456, 458, 460 and 462 are spaced along the length of the mount 450 to improve the heat dissipation of mount 450. They may also be mounted at the same vertical position along the length of unit 420 or with different spacings than the one shown. Different numbers of LEDs may also be employed. For example, a module like the module 450 might be modified to have two bands of four LEDs along the length of the module as illustrated in FIG. 4F, for example. For a corner wall unit two or three LEDs might be employed with no LED on a surface or surfaces of the module facing the wall.

FIG. 4C shows a further end cap unit 440 formed from a further piece of T-shaped aluminum 6061. The width w of end cap unit 440 is substantially the same as the length of the bases 402 and 404 of pieces 406 and 408. Ends 442 and 444 are bent up at an angle β of approximately 45° and an LED 464 is mounted on surface 446 of unit 440.

As seen in FIG. 4D, the base unit 420 of 4B and the end cap unit 440 of FIG. 4C are combined to form mount 450 by inserting leg 448 of preform 440 between bases 402 and 404 and securing the base unit 420 and end unit 400 together.

Figure 4E:
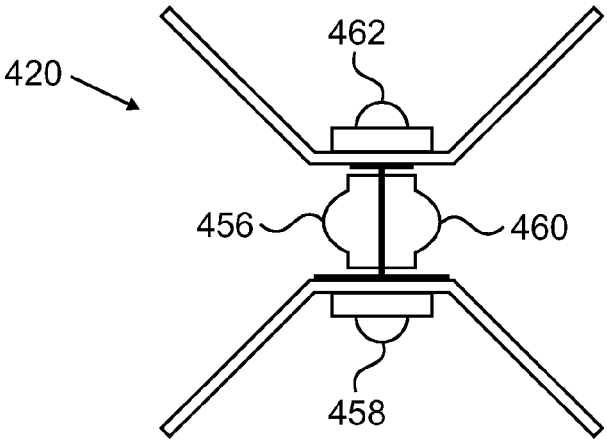
Figure 4F:
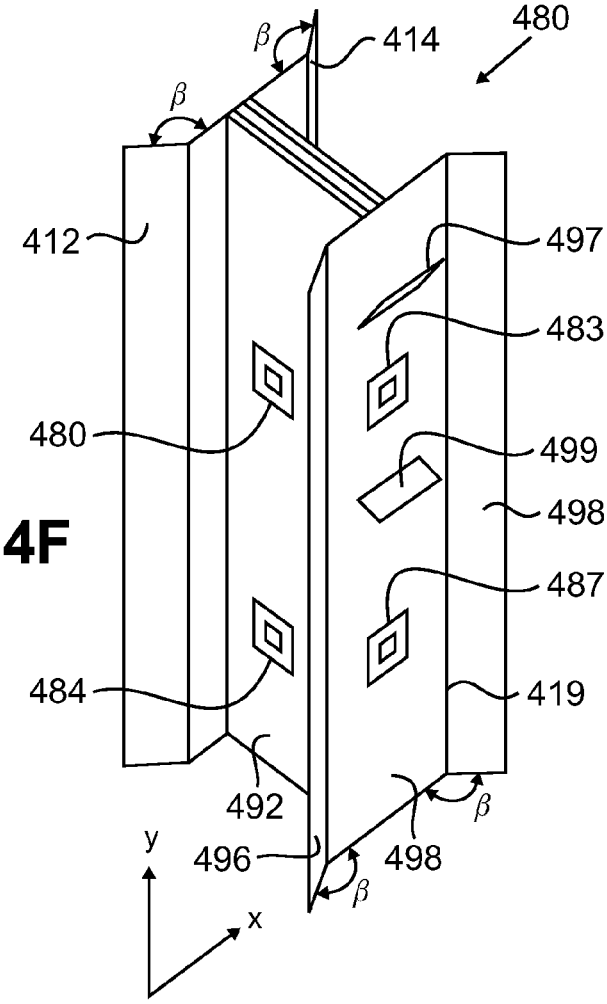

As seen in FIG. 4E which shows a top view of base unit 420, the bending described above results in angled heat sink fins which are advantageously located in illumination gaps for the LEDs 456, 458, 460 and 462 as discussed further below in connection with FIGS. 6A and 6B. Thus, a large and effective heat dissipating surface area is provided without substantial interference with the bulk of the illumination provided by the LEDs 456, 458, 460 and 462. For four LEDs driven with a current of 350 mA, the module 450 provides each LED with a cooling surface area of more than 4 square inches/watt thereby providing adequate passive thermal protection so that the LEDs do not run away.

FIG. 4F shows an alternative arrangement 480 in which two bands of four LEDs 480-483 and 484-487, respectively, are spaced apart along the vertical length of a mounting module 492. As seen for LED 483 on face 498, additional heat fins 497 and 499 may be provided so that heat fins are located in illumination gaps in both the x- and y-dimensions.

Figure 5:
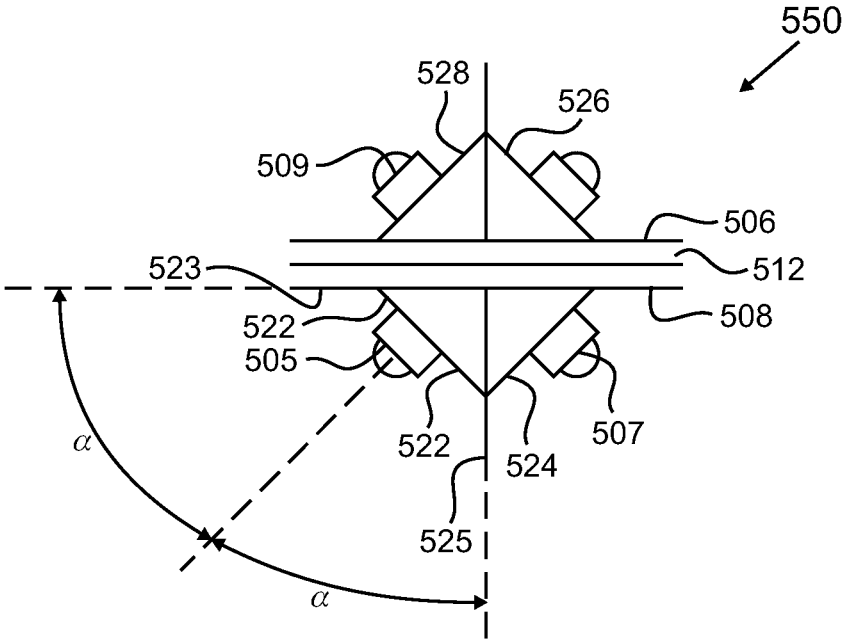
FIG. 5 illustrates an alternative LED mounting embodiment in accordance with the present invention.

FIG. 5 shows an alternative mount arrangement 550 formed from two T-shaped pieces 506 and 508 with a thermal gap filler 512 between them and angled mount supports 522, 524, 526 and 528 arranged as follows. Taking mount support 522 by way of example, it is seen that heat dissipating fins or legs 523 and 525 are angled with respect to a normal N to an LED chip 506 mounted thereon at an angle γ so that these heat dissipating fins are located in illumination gaps for the LED chip 505 and the neighboring LED chips 507 and 509.

Figure 6A:
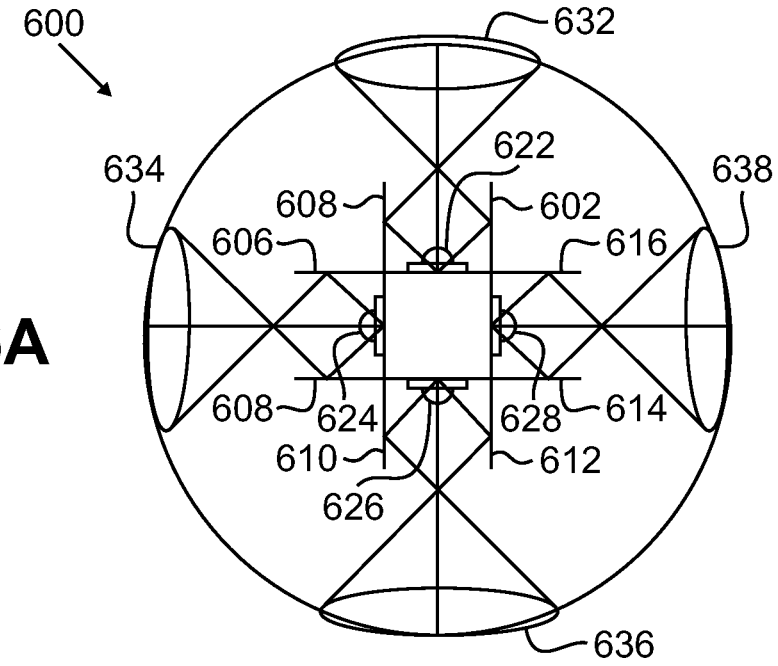
FIG. 6A illustrates an arrangement not in accordance with the present invention in which heat sink fins are not located in illumination gaps and hot spots result.

FIG. 6A illustrates a mounting arrangement 600 not in accordance with the present invention As illustrated in FIG. 6A, a plurality of pairs of heat sink fins 602 and 604, 606 and 608, 610 and 612, and 614 and 616 are not located in the illumination gaps of multiple LEDs 622, 624, 626 and 628, respectively. As a result, they result in reflection of substantial amounts of illumination from the LEDs 622, 624, 626 and 628 resulting in hot spots 632 634, 636 and 638, respectively, which are generally not pleasing to a typical observer and thus arrangement 600 while providing an adequate heat sink does not provide an acceptable lighting fixture.

Figure 1A:
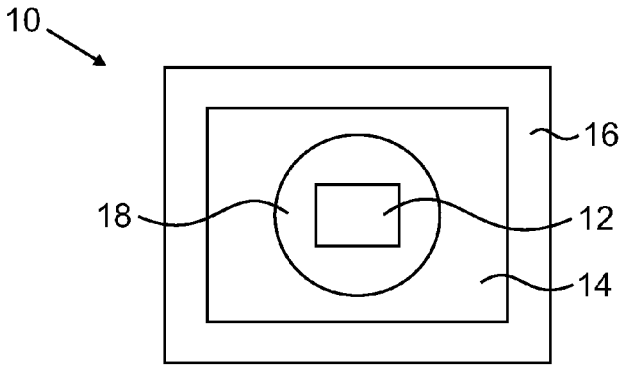
FIG. 1A illustrates a top view of a mounting arrangement for a prior art LED.
Figure 1B:
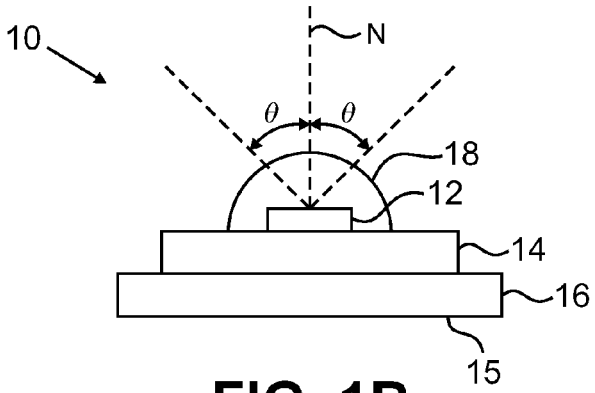
FIG. 1B shows a side view of the LED of FIG. 1A.
Figure 1C:
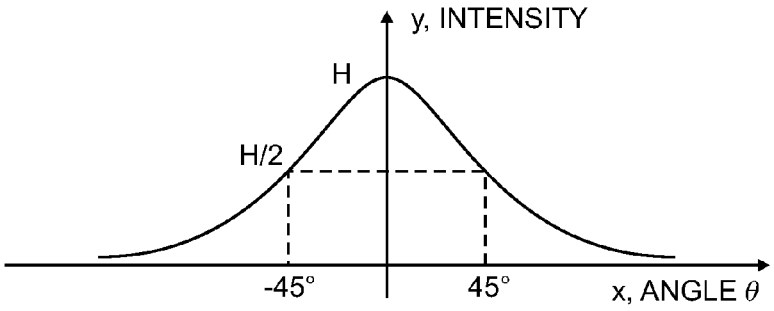
FIG. 1C shows an illustrative plot of light emitted by the LED of FIGS. 1A and 1B with intensity, I, plotted versus angle, θ.
Figure 2A:
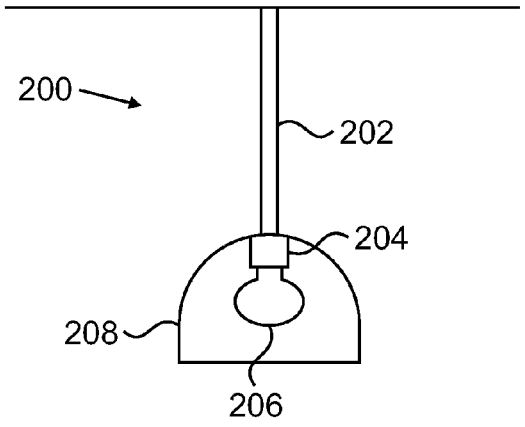
FIG. 2A illustrates an exemplary prior art chandelier fixture with an incandescent or fluorescent bulb providing illumination.
Figure 2B:
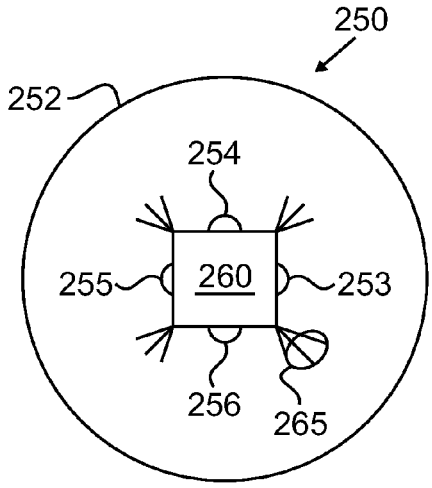
FIG. 2B illustrates a prior art attempt at an LED based chandelier fixture.
Figure 6B:
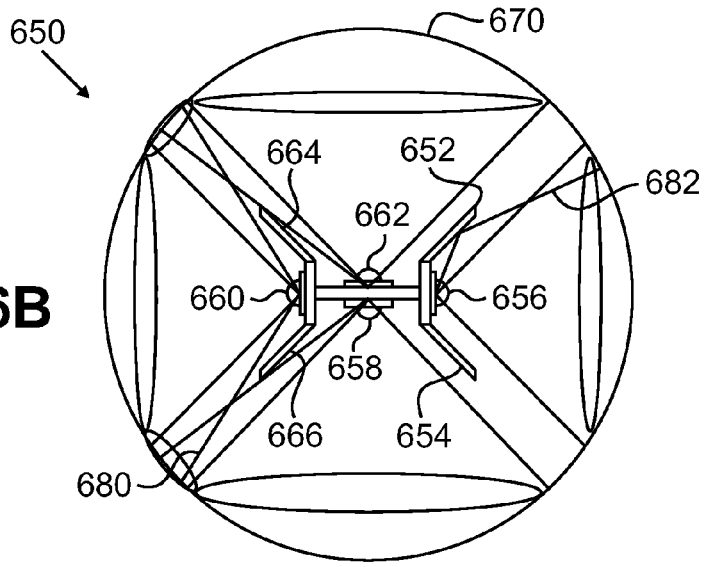
FIG. 6B illustrates aspects of how an embodiment in accordance with the present arrangement avoids hot spots.

By contrast, FIG. 6B illustrates how a mounting arrangement 650 in accordance with the present arrangement provides a much more diffuse lighting output without unacceptable hot spots. With fins 652, 654, 664 and 666, angled at 45°, the bulk of the illumination from the LEDs 656, 658, 660 and 662, such as the LED 10 of FIGS. 1A-1C having a viewing angle of 90°, passes directly to glass 670. Rays such as ray 680 have substantially reduced intensity at the angle shown and add with other reduced intensity rays to make the fall off at the corners less noticeable. Similarly, rays such as ray 682 hit fin 652 at a shallow angle and are reflected so as to add with other reduced intensity rays to again reduce the fall off at the corners. Thus, the fins 652, 654, 664 and 666 are effectively in illumination gaps in which intensity of illumination from the LEDs 656-660 is less than 50% and hot spots are avoided.

Figure 7:
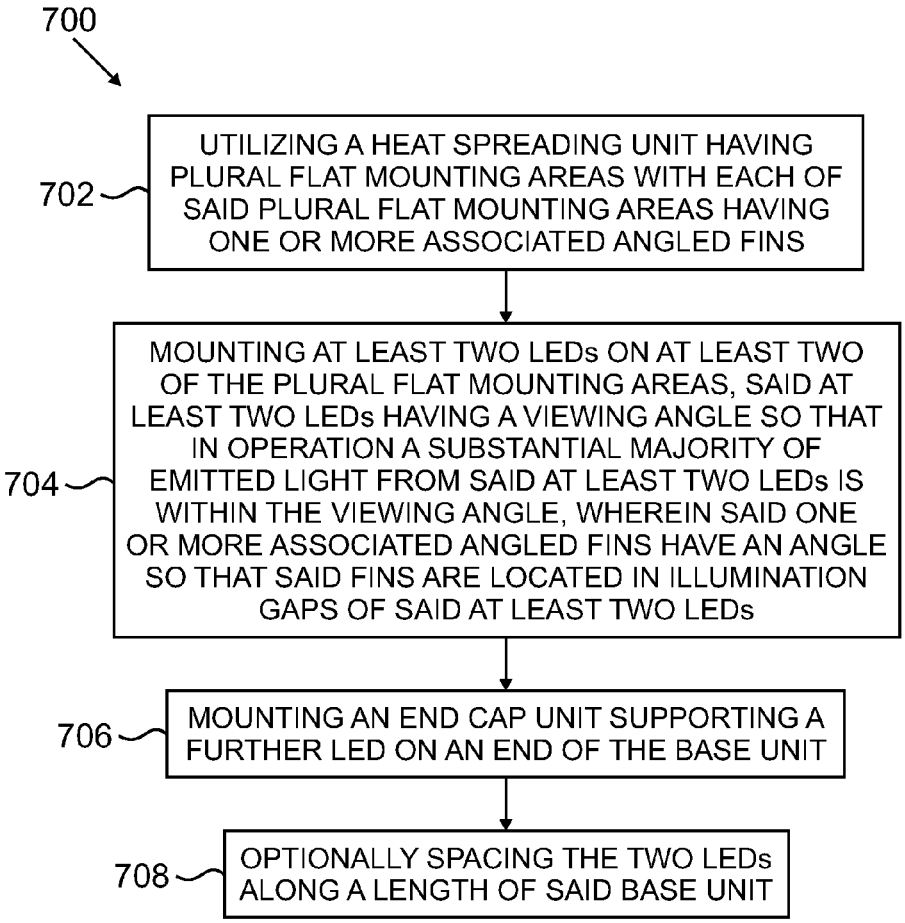
FIG. 7 is a flowchart of a method of mounting LEDs in accordance with the present invention.

FIG. 7 illustrates a method 700 of mounting heat spreading light emitting diodes (LEDs) to avoid hot spots in accordance with the present invention. In step 702, a heat spreading base unit having plural flat mounting areas with each of said plural flat mounting areas having one or more associated angled fins is utilized. In step 704, at least two LEDs are mounted on at least two of the plural flat mounting areas, said at least two LEDs having a viewing angle so that in operation a substantial majority of emitted light from said at least two LEDs is within the viewing angle, wherein said one or more associated angled fins have an angle so that said fins are located in illumination gaps of said at least two LEDs. In step 706, an end cap unit supporting a further LED is mounted on an end of the base unit. Optionally, in step 708, two or more LEDs are spaced along a length of said base unit and heat sink fins are provided in illumination gaps in two dimensions.

In step 704, four LEDs may be mounted about a central axis of the base unit and eight angled fins then are angled at an angle $\gamma$ of approximately 45° with respect to normals, N, to four flat mount areas on which the four LEDs are mounted. Further, portions of said base unit contacting said at least two LEDs may suitably have a conductivity of at least approximately 160° C./watt.

The method 700 may further comprise the step of forming said base unit from two T-shaped bars with their bases secured together, and a layer of thermal gap material may be advantageously clamped between said bases of the T-shaped bars.

In step 704, said at least two LEDs may suitably have a viewing angle of 90°. Further, in said illumination gaps, the intensity of light emitted by said LEDs is less than or equal to 50% of the maximum intensity of light emitted thereby.

While the present invention has been disclosed in the context of various aspects of presently preferred embodiments, it will be recognized that the invention may be suitably applied to other environments consistent with the claims which follow. By way of example, while the present invention has been disclosed primarily in the context of a pendant chandelier embodiment, it will be recognized that the present teachings may be readily adapted to floor, wall and other mountings of lighting fixtures. While presently preferred materials and arrangements of exemplary numbers of LEDs are described herein, other materials and arrangements may be adapted to particular lighting environments. For example, a material or materials other than or in addition to aluminum may be employed to dissipate heat. As a further example, for LEDs having a viewing angle of 120°, three LEDs on a triangular mount with fins at 120° might be employed consistent with the teachings herein.

I claim:

1. A light emitting diode lighting apparatus comprising:

an elongated heat sink having a first portion with heat sink fins extending near one end and a second portion providing at least four flat light emitting diode (LED) mounting areas at an other end from said one end;

a plurality of LEDs mounted upon the second portion on the at least four flat LED mounting areas; and a transparent enclosure around the elongated heat sink, wherein the heat sink fins extending near one end extend outside the transparent enclosure.

2. The light emitting diode lighting apparatus of claim 1 further comprising at least four LEDs mounted at the same vertical position along a length of the elongated heat sink.

3. The light emitting diode lighting apparatus of claim 1 further comprising a top mount in spaced relationship with a top portion of the transparent enclosure thereby creating at least a first air passageway between the top mount and the top portion of the transparent enclosure.

4. The light emitting diode lighting apparatus of claim 3 wherein a bottom portion of the transparent enclosure has at least one opening and during operation of the light emitting diode lighting apparatus, heat dissipating air flows through the at least one opening of the bottom portion of the transparent enclosure up along the heat sink fins of the elongated heat sink and out the first air gap passageway.

5. The light emitting diode lighting apparatus of claim 1, wherein the heat sink fins extend outwardly from a central axis of said lighting apparatus.

6. The light emitting diode lighting apparatus of claim 2, further comprising at least two bands of at least four LEDs spaced apart along the second portion.

7. The light emitting diode apparatus of claim 1, wherein said one end of the first portion comprises a power connection.

8. The light emitting diode apparatus of claim 1, wherein the elongated heat sink has a conductivity of at least 160° C./watt.

9. The light emitting diode apparatus of claim 1, wherein the heat sink fins are angled so that they are located in illumination gaps for the plurality of LEDs.

10. The light emitting diode apparatus of claim 1, wherein the elongated heat sink has a cooling surface of more than four square inches/watt to provide adequate passive thermal protection so that the plural LEDs do not run away.

11. A method of lighting utilizing a light emitting diode apparatus comprising:

providing an elongated heat sink having a first portion with heat sink fins extending near one end and a second portion providing at least four flat light emitting diode (LED) mounting areas on an other from said one end;

mounting a plurality of LEDs upon the second portion on the at least four flat LED mounting areas; and enclosing the elongated heat sink with a transparent member, wherein the heat sink fins extending near the one end extend outside the transparent enclosure.

12. The method of claim 11 further comprising:

mounting at least four LEDs spaced apart along the second portion.

13. The method of claim 11 further comprising:

establishing a top mount in spaced relationship with a top portion of the transparent enclosure thereby creating at least a first air passageway between the top mount and the top portion of the transparent enclosure.

14. The method of claim 13 wherein a bottom portion of the transparent enclosure has at least one opening and during operation of the light emitting diode lighting apparatus, heat dissipating air flows through the at least one opening of the bottom portion of the transparent enclosure up along the heat sink fins of the elongated heat sink and out the first air gap passageway.

15. The method of claim 11, wherein said heat sink fins extend outwardly from a central axis of said lighting apparatus.

16. The method of claim 15, further comprising:

mounting at least two boards of at least four LEDs spaced apart along the second portion.

17. The method of claim 11, wherein power is supplied to a power connection located at said one end of the first portion.

18. The method of claim 11, wherein the elongated heat sink has a conductivity of at least 160° C./watt.

19. The method of claim 11, further comprising:

angling the heat sink fins so that they are located in illumination gaps for the plurality of LEDs.

20. The method of claim 11, further comprising:

providing adequate passive thermal protection so that the plural LEDs do not run away by insuring the elongated heat sink has a cooling surface of more than four square inches/watt.

* * * * *